United States Patent [19]

Haworth

[11] 4,442,673

[45] Apr. 17, 1984

[54] COMBINATION CYCLE, DUAL PROCESS ENGINE

[75] Inventor: Floy Haworth, Monett, Mo.

[73] Assignee: Juanita J. Haworth, Monett, Mo.

[21] Appl. No.: 406,439

[22] Filed: Aug. 9, 1982

Related U.S. Application Data

[63] Continuation of Ser. No. 210,037, Nov. 24, 1980, abandoned.

[51] Int. Cl.[3] ..... F01K 23/14

[52] U.S. Cl. ..... 60/618; 60/307

[58] Field of Search ..... 60/307, 618; 123/41.33

[56] References Cited

U.S. PATENT DOCUMENTS

| | | | |
|---|---|---|---|
| 2,437,489 | 3/1948 | Vokes | 123/41.33 |
| 3,192,706 | 7/1965 | Dolza | 60/307 X |
| 4,031,705 | 6/1977 | Berg | 60/618 X |
| 4,075,837 | 2/1978 | Hanaoka | 60/307 X |
| 4,273,082 | 6/1981 | Tholen | 123/41.33 X |

FOREIGN PATENT DOCUMENTS

| | | | |
|---|---|---|---|
| 2298686 | 8/1976 | France | 60/618 |

*Primary Examiner*—Michael Koozo

[57] ABSTRACT

An engine including at least one set of three cylinders. Two of the cylinders function as internal combustion cylinders and the remaining cylinder functions as an air compressor. The air is injected into the exhaust manifold of the combustion cylinders. The combustion products are fed to a steam generator, the steam being utilized to produce work in a steam engine or turbine. The supply water for the steam generator is in heat exchange relationship with the engine cooling liquid. The compressor intake air is in heat exchange relationship with the engine lubricating liquid.

2 Claims, 11 Drawing Figures

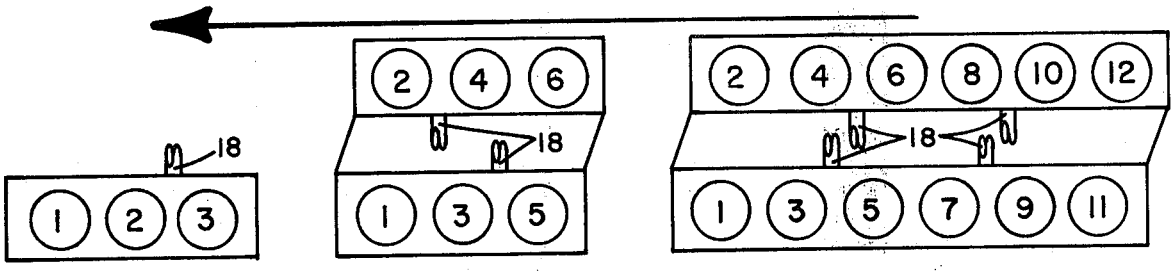
FIG. 6-A FIG. 6-B FIG. 6-C
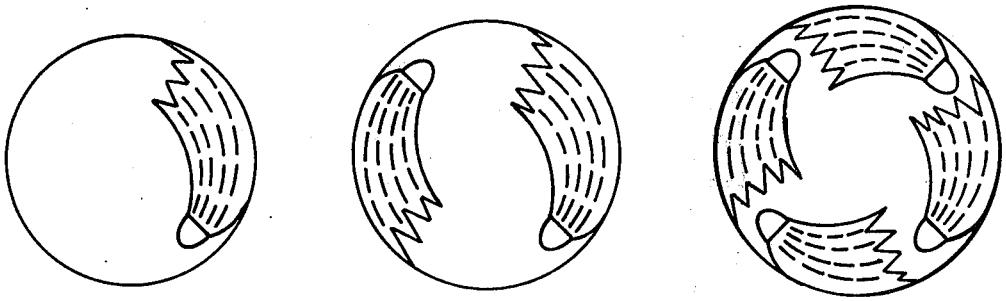
FIG. 7-A FIG. 7-B FIG. 7-C

COMBINATION CYCLE, DUAL PROCESS ENGINE

This application is a continuation of application Ser. No. 210,037, filed Nov. 24, 1980, and now abandoned.

SUMMARY

This invention relates to fuel conservation. It has long been known that a large part of the potential of a gallon of fuel moves through the exhaust port while it is still burning. This is to clear the combustion chamber to accept a fresh charge of combustible mixture and to carry away destructive heat. Radiators or cooling fins, plus fans, push away a great deal of heat also. Internal combustion engines trap air, heat it, expand it against a piston to produce torque at crankshaft. Steam generators trap water, heats it, expands it into steam pressure for power. I believe both processes can be adapted to function from the same burning of fuel and utilize this waste in a productive manner. This engine would produce torque plus steam. A steam turbine or piston type steam unit would be needed to put the steam to work. A special transmission and controls to accommodate both would give the engine a self-regulating characteristic. The harder it works, the more steam it will produce. The more steam it has, the less it is loaded. Also with the proper range of gear reduction, a vehicle with this engine could be started and moved out immediately. However, it would be a low key performer until the steam began to assist.

DESCRIPTION OF THE DRAWINGS:

FIG. 6 shows the cylinder numbering pattern and the location of the exhaust flame pipes 18. 6A identifies the three cylinder unit. 6B identifies the six cylinder unit. 6C identifies the twelve cylinder unit.

FIG. 7 shows the exhaust injection into the steam generator. 7A identifies the three cylinder unit. 7B identifies the six cylinder unit. 7C identifies the twelve cylinder unit.

Figure 1:
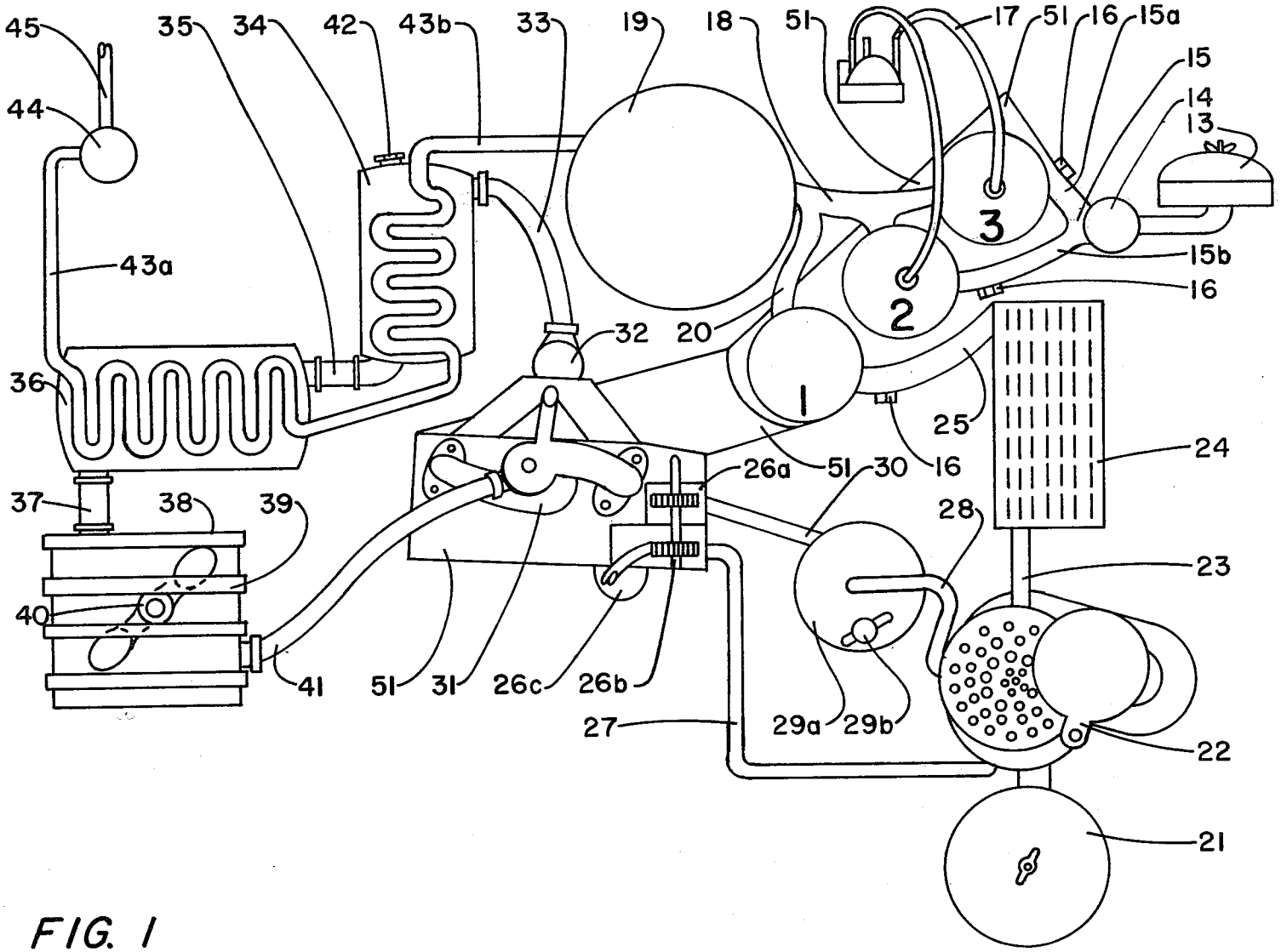
FIG. 1 is a schematic used to explain the operation of the three cylinder unit having a fan and radiator.

DETAILED DESCRIPTION:

The engine will require three cylinders to function and additional cylinders will be added in teams of three interdependent cylinders. Cylinders numbers 2 and 3 will run as a two cylinder, four cycle engine and will be on top dead center at the same time. The two firing cylinders, numbers 2 and 3 will fire on different strokes. The schematic in FIG. 1 will be used to explain the operation. Air will be drawn through the carburetor air filter 13, carburetor 14, intake manifold 15 into cylinder 2 or 3 where the ignition system 17, of a conventional type, will ignite the mixture at the proper time. A power stroke will occur each 360 degrees of crankshaft rotation. Each intake pipe, 15A, 15B, and 25 will have a drain valve 16 that will open when the engine is not running to drain away flooding, possible condensation and provide early detection of leaks, coolant or otherwise. The vacuum in pipe 25 will not satisfactorily hold valve 16 closed. The cylinders 2 and 3 will exhaust through the same exhaust port, through as short a pipe 18 as possible into the steam generator 19. Each exhaust flame will be joined by the discharge from air pump cylinder 1 through pipe 20. Air pump cylinder 1 will receive no spark or fuel but will operate as a two cycle air pump. Being two cycle it will deliver a pulse of air for each exhaust flame the two firing cylinders 2 and 3 produce. Its exhaust valve will be timed to open at the same time as the exhaust valve of cylinders number 2 and 3 and since the air pump piston in cylinder number 1 will be approximately 5 degrees into its exhaust stroke when the exhaust valve opens, the crankshaft will be manufactured to cause the air pump piston, cylinder 1, to reach top dead center approximately 54 degrees of crankshaft rotation ahead of the two firing cylinders. The same half speed camshaft, used for the firing cylinders, can be double lobed for the two cycle valve action for the air pump cylinder 1. Cyinder 1 will not demand much power because very little back pressure will be encountered. The air pump cylinder 1 will intake filtered air that has passed through an air filter 21, that provides air for the air pump cylinders only, oil cooler 22, a connecting pipe 23, an oversize rocker arm cover 24, and pipe 25, in that order. With this movement of air through the rocker arm cover 24, sodium filled exhaust valves in the firing cylinders will probably pay substantial dividends in valve life. The rocker arm cover 24 will also house a considerable number of heat radiating fins, part of which could be attached by bolts or screws. As the air is drawn into pipe 25, a certain amount of baffling to separate any oil from the air will be necessary. However, should oil become a problem it can still be separated in pipe 20. Adding a mixture of hot fresh air and crankcase fumes to the exhaust flame, as said flame enters the steam generator 19, will amplify said flame in both size and duration, resulting in a cleaner exhaust and more heat for the steam generation. The oil pump 26A and 26B will be a double unit. Pump 26A will supply lubricating oil under pressure to the engine. Pump 26B will scavenge oil from the engine oil sump 26C and push it through the oil line 27 to the thermostatically controlled oil cooler 22, through oil line 28 to the oil supply tank 29A where oil will gravity feed through oil line 30 to oil pump 26A. The oil level will be checked and maintained through the oil filler cap 29B. The air flow through the oil cooler 22 must not be reduced to compensate for cold weather, unless as it is progressively reduced a by-pass must be progressively opened, because the air pump cylinder 1 will quickly build a destructive vacuum. Also the cylinder head is depending on this air flow for part of its cooling. Meanwhile, the belt driven coolant pump 31 will circulate coolant inside the block and head of engine 51, until operating temperature is reached, at which time thermostat 32 will function directing coolant through hose 33 to a coolant-to-feedwater heat exchange unit 34 through hose connection 35 to the second heat exchange unit 36. The feedwater and engine coolant will move in opposite directions through the heat exchange units, where the engine coolant will become cooler and the feedwater becomes heated through forced convection. The coolant will continue through hose connection 37 to the radiator 38 where thermostatically controlled shutters 39 and the thermostatically controlled electric fan 40 will team up to prevent the coolant temperature from rising above 115 degrees centigrade. The coolant hose 41 will return coolant to the coolant pump 31. The coolant filler cap 42 will be fourteen pounds per square inch relief type. The coolant will be permanent anti-freeze full strength. The feedwater pipe 43A goes to the heat exchange unit 36. The feedwater pipe 43B goes to the steam generator 19. 44 is the feedwater pump. Pipe 45 comes from the feedwater tank. As the feedwater pipe will be under boiler pressure from the feedwater pump on to the steam generator, it and the steam generator 19 will have to be carried by the engine mounts to maintain rigidity, so therefore the engine mounts will have to be large enough to carry extra weight. 51 is the number used to identify the engine in a stretched out, exaggerated position making it easier to isolate and explain the four systems, which includes: the four cycle internal combustion section; the two cycle air pump section; the coolant system; and the oil system. The number 51 is used only in the schematic drawings of FIG. 1 and FIG. 2.

Figure 2:
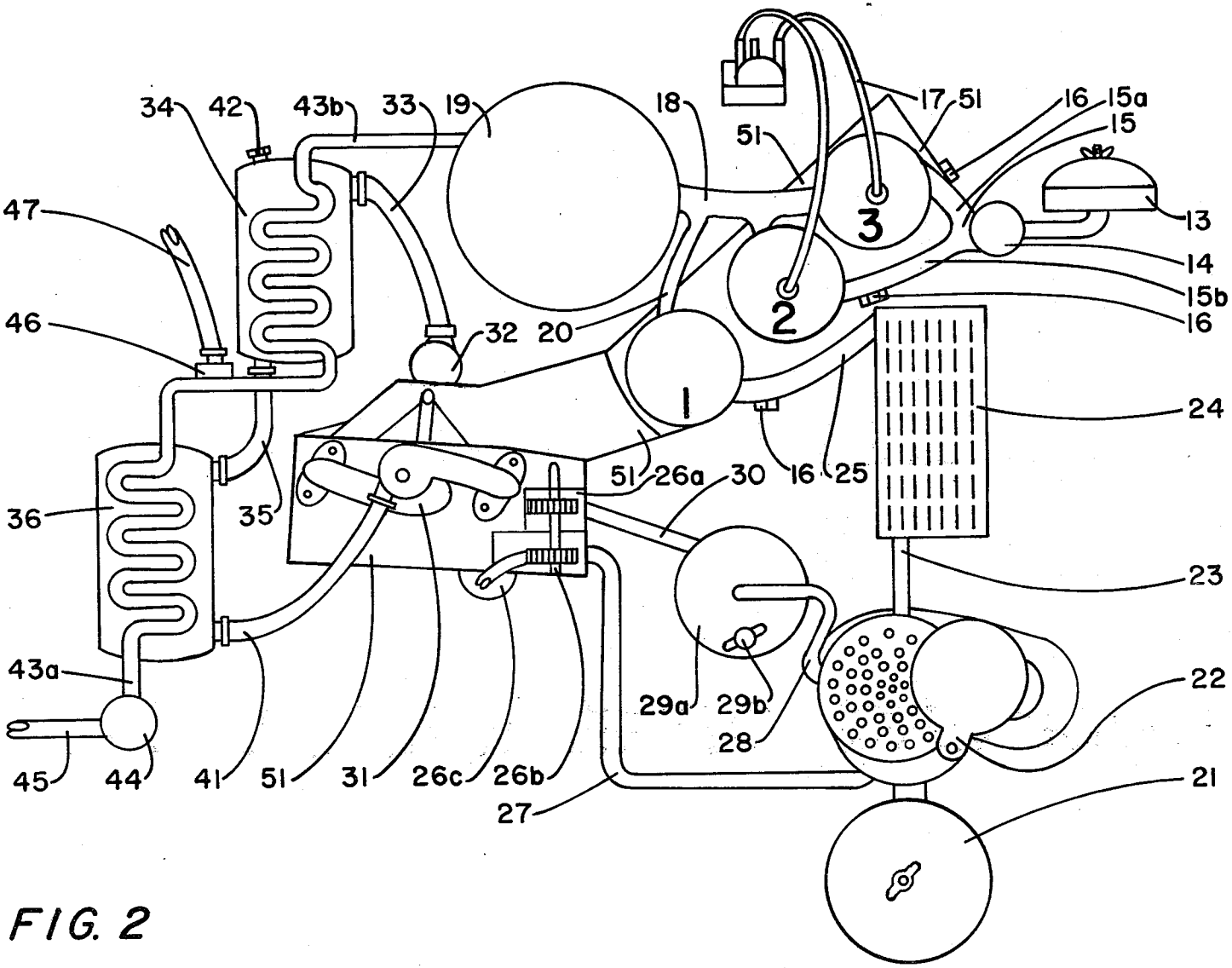
FIG. 2 is a schematic used to explain the operation of the three cylinder unit having no fan or radiator.

FIG. 2 is a schematic operating exactly as described for FIG. 1 up to the management of the coolant, or number 31. The fan and the radiator will be eliminated entirely. The coolant pump 31 will circulate coolant inside coolant passages of the head and block of engine 51 until operating temperature is reached which will be rather high, aiming at 120 degrees centigrade, at which time, thermostat 32 will function sending the coolant through pipe 33 to a coolant-to-feedwater heat exchange unit 34. Here the coolant heat will be transferred to the incoming feedwater, by forced convection. The temperature control valve 46 between the two temperature transfer units 34 and 36 will open and enough feedwater will be circulated from the feedwater pump 44 through the heat exchange unit 36, control valve 46, through pipe 47, back through the main steam condenser to the feedwater tank to prevent a coolant temperature rise above 125 degrees centigrade. To handle this extra load, the capacity of the steam condenser should be increased. If the high coolant temperature should cause a problem, it could be lowered slightly until the problem disappears. However, I believe this high coolant temperature can be tolerated because of the top end cooling by the intaking of the air pump cylinder through the rocker arm cover, where it is exposed to considerable metal surface, valve springs, valve stems, rocker arms, cooling fins, etc., and the bottom end cooling by moving heat from the bearings and crankcase to the oil cooler 22. The coolant pressure relief valve 42 will be increased to twenty one pounds per square inch. Permanent anti-freeze coolant, full strength, the ethylene glycol variety, will be used in the coolant system. From the second heat exchange unit 36, the coolant will pass through hose connection 41 back to the water pump 31. Since the feedwater pipe will be under boiler pressure from the feedwater pump on to the steam generator, it and the steam generator will have to be carried by the engine mounts to maintain rigidity, so therefore the engine mounts will have to be large enough to carry extra weight. Number 51 is used to identify the engine in a stretched out exaggerated position making it easier to isolate and explain the four systems, which includes: the four cycle internal combustion section; the two cycle air pump section; the coolant system; and the oil system. The number 51 is used only in the schematic drawings of FIG. 1 and FIG. 2.

Figure 3:
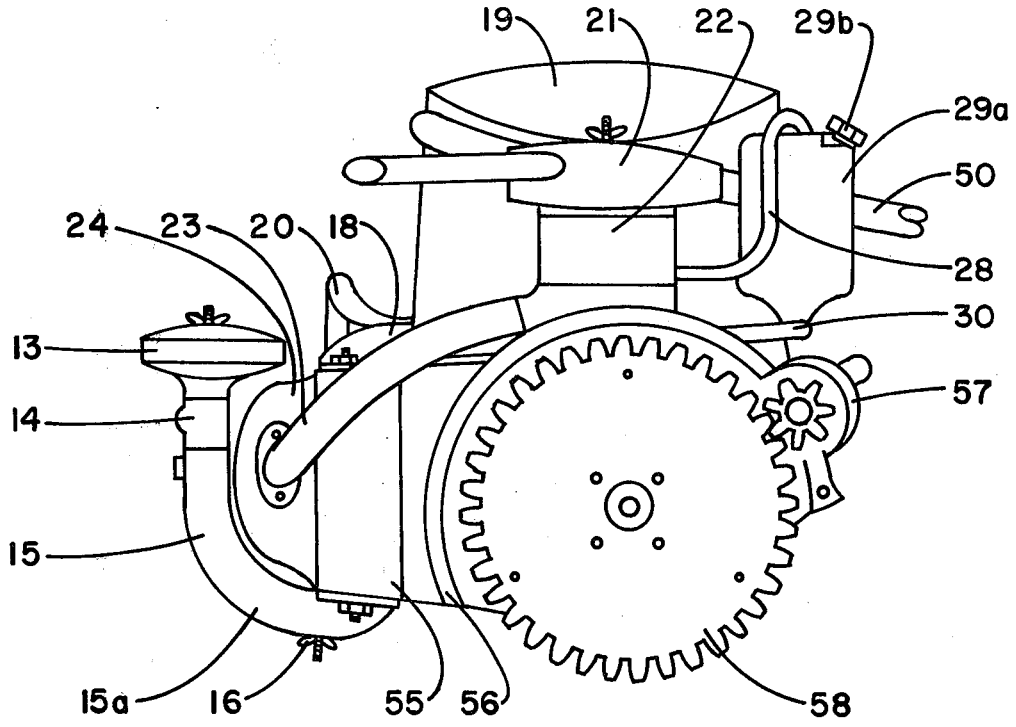
FIG. 3 is a rear view of a three cylinder engine with the visible parts identified by the same numbers assigned to parts for all of the drawings.

FIG. 3 is a three cylinder unit with some additional parts identified. A pipe 50 carries away the spent exhaust gases from the steam generator 19. The cylinder head is identified by the number 55. The engine cylinder block is identified by the number 56. The electric starter is identified by the number 57. The flywheel is identified by the number 58. Viewed from the flywheel end, the engine will lie on its left side. It will intake from the bottom and exhaust into a steam generator 19 carried above and close. The firing order is 2–3. See FIG. 6A for the numbering pattern. The timing procedure will be done on cylinder number 2. Note that pipe 23 introduces air into the rocker arm cover 24 at the hot end, or firing cylinder end of the engine. Air will be extracted from the rocker arm cover at the other end, which is adjacent to an air pump cylinder, through pipes 25 (not shown on FIG. 3). Also pipe 20 carrying air from the exhaust port of the air pump cylinder to the exhaust pipe 18 should inject at an angle to insure a merge and mix rather than a collision which could cause erratic back pressure.

Figure 4:
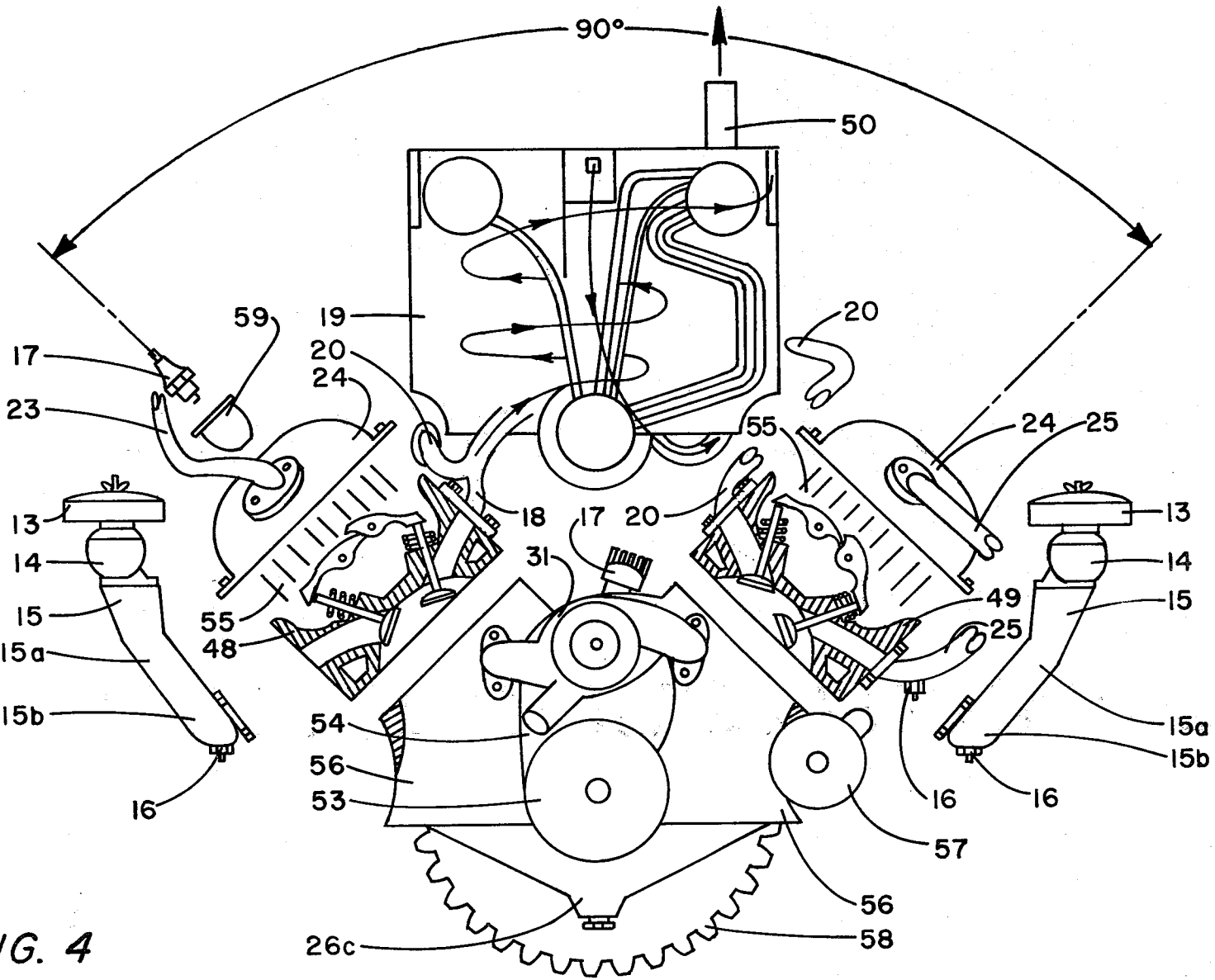
FIG. 4 is a front view of a V-6 engine, comprising two three cylinder teams, with the visible parts numbered.

FIG. 4 is a front view of a V-6 engine partially exploded, and a cutaway 48 of a firing cylinder showing that the hemisphere combustion chamber with flow through valving is used. Its desirability being that it can provide a shorter exhaust travel upward and inboard to the fire box of the steam generator and still avoid a dead-end passageway at the combustion chamber of the engine. A through-the-rocker-arm-cover sleeve is used only on the firing cylinders. The cylinder head 55 shows the heat radiating fins that will cool the engine and heat the air going into what is shown as a cutaway air pump cylinder 49. It has no spark plug and receives no fuel. The drawings of the steam generator 19 are only an approximation. The steam generator should be built by a reputable manufacturer who has experience in building small steam generators and should be allowed the freedom to take full advantage of a pulsating flame that is instantly variable by the throttle and can be aimed somewhat and is rather intense, sometimes reaching 1800 degrees F. It would also provide a turbulent, metered movement of the hot gases through the steam generator. FIG. 4, FIG. 6A, and FIG. 6B also shows that it would be possible to manufacture cylinder heads, rocker arm assemblies and rocker arm covers to fit either bank or the three cylinder units. Two identical intake manifolds 15 would be used. The location of the scavenger pump sump 26C, the crankshaft pulley 53, the timing gear cover 54, are also shown. The V-6 would be a 90 degree V block with the crankshaft designed for a power stroke each 180 degree crankshaft rotation. The firing order is 3–2–5–4. See FIG. 6B for the cylinder numbering. The timing procedure would be done on cylinder number 3. A muffler should not be necessary. Neither should the long crooked, rusty pipe extension back underneath the vehicle, as the exit stack should be sufficiently cool to retain a paint or chrome finish.

Figure 5:
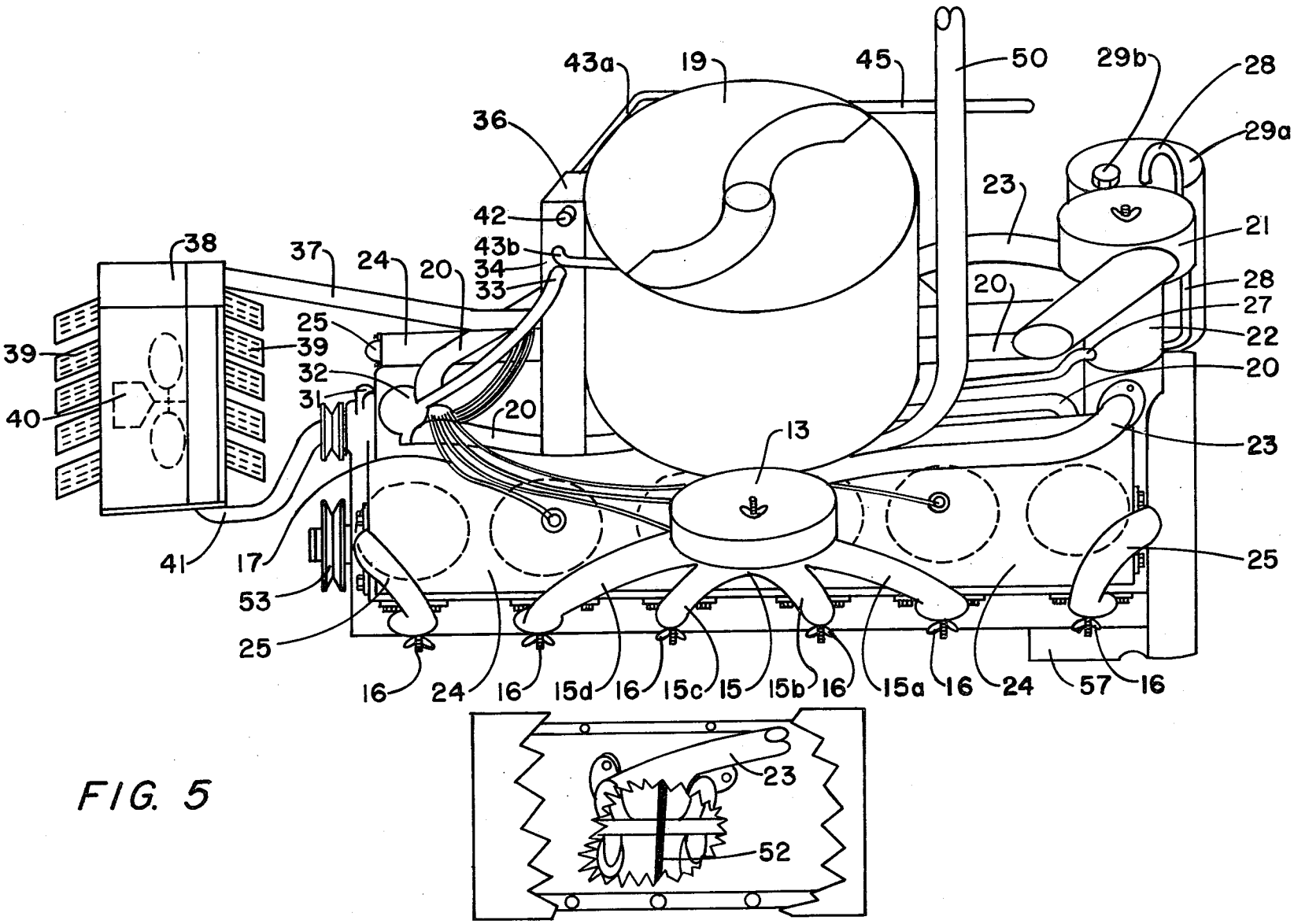
FIG. 5 is a left side looking down on a V-12 engine, comprising four three cylinder teams, with the visible parts numbered.

FIG. 5 shows the left side view of a V-12 engine with visible parts numbered as in FIG. 1. Although little of the right bank is visible, it would be identical to the left bank. The cylinder head assemblies, rocker arm covers and intake maifold could be manufactured to be interchangeable. Note that on all V block engines, all intake will be from outboard. All exhaust will be inboard into a specially constructed steam generator above and between the banks. Also each air pump cylinder will pull air through the rocker arm cover 24 above only three cylinders. However, all air pump cylinders will draw air through the air pump cylinder air filter 21 and oil cooler 22. On the V-12 one pipe 23 for each bank will extend from the oil cooler 22 to the center point of the rocker arm cover 24 where it will fork and attach to two openings in the rocker arm cover. One opening will be on each side of the partition 52 (see inset). The engine block will be a 90 degree V block with a power impulse each 90 degrees. The firing order will be 3-1-0-7-6-5-8-9-4. See FIG. 6C for the numbering pattern. Cylinder number 3 will be used for the timing procedure. Cylinders 1,2,11, and 12 will be two cycle air pump cylinders and will receive no spark or fuel. It must be emphasized that the V-12 is four teams of three cylinders each, synchronized and co-ordinated to work from the same crankshaft, camshaft and cylinder block.

FIG. 6A is the cylinder numbering pattern for the three cylinder engine. FIG. 6B is for the V-6 engine. FIG. 6C is for the V-12 engine. The arrow points from the flywheel toward the crankshaft pulley end of the engine. The three cylinder engine with a firing order of 2-3 would push an exhaust flame through the one exhaust flame pipe 18 into the steam generator each 360 degrees of crankshaft rotation and would be somewhat like FIG. 7A. A V-6 is represented by FIG. 7B. Its firing order is 3-2-5-4. It exhausts each 180 degrees of crankshaft rotation through two points of injection into the steam generator. A V-12 is represented by FIG. *7c*. Its firing order is 3-10-7-6-5-8-9-4. It exhausts each 90 degrees of crankshaft rotation through four points of injection into the steam generator.

What is claimed as new and desired to be secured by Letters Patent is:

1. Apparatus for providing mechanical power from normally wasted engine heat comprising:

at least one set of three adjacent in-line cylinders, two of said cylinders being engine cylinders and one of said cylinders being a compressor cylinder, a carburetor for supplying fuel to the engine cylinders, and means for igniting said fuel, said engine cylinders operating on a four-stroke cycle, means for supplying air to the compressor cylinder, said engine cylinders including a liquid cooling system, a lubricating system and an exhaust manifold, a steam generator connected to said exhaust manifold, means for supplying a liquid to said steam generator, said liquid being vaporized through heat exchange with the engine exhaust gases, the outlet of the compressor cylinder being connected to the exhaust manifold upstream of the steam generator, one of said engine cylinders firing each 360 degrees of crankshaft rotation and each compression stroke coinciding with every exhaust stroke of said engine cylinders in order to combust inburned fuel in the exhaust manifold, said lubricating system including a high pressure pump, a scavenging pump and an oil cooler, said oil cooler being located in heat exchange relationship with the means for supplying air to the compressor, said scavenging pump moving oil from the engine crankcase through said oil cooler, the means for supplying air to the compressor including an engine vavle cover having surface fins thereon, said engine liquid cooling system including a pump and two heat exchangers in series and in heat exchange relationship with the means for supplying liquid to said steam generator, a radiator and a coolant temperature controlled electric fan for regulating the temperature of the engine coolant, and a steam engine connected to said steam generator.

2. Apparatus for providing mechanical power from normally wasted engine heat comprising:

at least one set of three adjacent in-line cylinders, two of said cylinder being engine cylinders and one of said cylinders being a compressor cylinder, a carburetor for supplying fuel to the engine cylinders, and means for igniting said fuel, said engine cylinders operating on a four-stroke cycle, means for supplying air to the compressor cylinder, said engine cylinders including a liquid cooling system, a lubricating system and an exhaust manifold, a steam generator connected to said exhaust manifold, means for supplying a liquid to said steam generator, said liquid being vaporized through heat exchange with the engine exhaust gases, the outlet of the compressor cylinder being connected to the exhaust manifold upstream of the steam generator, one of said engine cylinders firing each 360 degrees of crankshaft rotation and each compression stroke coinciding with every exhaust stroke of said engine cylinders in order to combust unburned fuel in the exhaust manifold, said lubricating system including a high pressure pump, a scavenging pump and an oil cooler, said oil cooler being located in heat exchange relationship with the means for supplying air to the compressor, said scavenging pump moving oil from the engine crankcase through said oil cooler, the means for supplying air to the compressor including an engine valve cover having surface fins thereon, said engine liquid cooling system including a pump and two heat exchangers in series and in heat exchange relationship with the means for supplying liquid to said steam generator, an engine coolant temperature controlled valve located in the means for supplying a liquid to said steam generator and between said two heat exchangers, a conduit connected to said valve for bypassing liquid around one of said heat exchangers for regulating the temperature of the engine coolant, and a steam engine connected to said steam generator.

* * * * *